US007152570B2

(12) United States Patent
Lagerlof et al.

(10) Patent No.: US 7,152,570 B2
(45) Date of Patent: Dec. 26, 2006

(54) LUBRICATION SYSTEM FOR AN INTERNAL COMBUSTION ENGINE

(75) Inventors: Fredrik Lagerlof, Gothenburg (SE); Kenneth Ask, Vastra Frolunda (SE)

(73) Assignee: Volvo Lastvagnar AB, Göteborg (SE)

( * ) Notice: Subject to any disclaimer, the term of this patent is extended or adjusted under 35 U.S.C. 154(b) by 0 days.

(21) Appl. No.: 11/160,930

(22) Filed: Jul. 15, 2005

(65) Prior Publication Data

US 2005/0241607 A1 Nov. 3, 2005

Related U.S. Application Data

(63) Continuation of application No. PCT/SE04/00011, filed on Jan. 9, 2004, now abandoned.

(30) Foreign Application Priority Data

Jan. 17, 2003 (SE) ..... 0300128

(51) Int. Cl.
*F01M 1/02* (2006.01)

(52) U.S. Cl. ..... 123/196 R; 184/6.5

(58) Field of Classification Search ..... 123/196 R; 417/307; 184/6.5
See application file for complete search history.

(56) References Cited

U.S. PATENT DOCUMENTS 6,161,515 A 12/2000 Kopec

*Primary Examiner*—Noah P. Kamen
(74) *Attorney, Agent, or Firm*—Novak Druce & Quigg, LLP

(57) ABSTRACT

Method and arrangement for providing a lubrication system for an internal combustion engine with at least one piston reciprocating in an engine cylinder. The lubrication system includes an oil pump (11) with adjustable feed pressure which is controlled via a pressure-sensing means (18) which is acted on by the working pressure of the oil. The pressure-sensing means (18) is acted on via a pressure outlet (21) which is hydraulically connected to one of the bearings of the internal combustion engine which are lubricated by the lubrication system.

10 Claims, 1 Drawing Sheet

LUBRICATION SYSTEM FOR AN INTERNAL COMBUSTION ENGINE

CROSS-REFERENCE TO RELATED APPLICATIONS

The present application is a continuation patent application of International Application No. PCT/SE2004/000011 filed 9 Jan. 2004 which was published in English pursuant to Article 21(2) of the Patent Cooperation Treaty, and which claims priority to Swedish Application No. 0300128-6 filed 17 Jan. 2003. Said applications are expressly incorporated herein by reference in their entireties.

FIELD OF THE INVENTION

The present invention relates to a lubrication system for an internal combustion engine with at least one piston reciprocating in an engine cylinder, which lubrication system comprises an oil pump with adjustable feed pressure which is controlled via a pressure-sensing means which is acted on by the working pressure of the oil.

BACKGROUND OF THE INVENTION

The lubrication system of an internal combustion engine circulates oil under pressure through the engine block and the cylinder head for lubricating and cooling its various moving parts, such as camshaft, crankshaft, pistons, and other bearings. Different variants of lubrication system have been proposed, which have had the function of varying the oil feed of the lubricating oil pump in relation to the requirements of the engine in order to reduce power losses. Use is usually made of a pressure-reducing valve on the delivery side of the pump, which valve makes it possible to return a surplus of oil to the suction side of the pump when pressure and flow to the consumers of the engine are sufficient.

One disadvantage of these known lubrication systems is that they do not take account of changes in the viscosity of the lubricating oil as a consequence of temperature variations. Moreover, the system pressure is affected by changes in pressure drop, for example owing to an oil cooler and oil filter being partly blocked by impurities. In this connection, the pressure adjustment described above can result in some consumers not receiving sufficient oil pressure for lubrication or cooling.

SUMMARY OF THE INVENTION

One object of the invention is therefore to provide a lubrication system which adjusts the system pressure in consideration of the requirements of the consumers, without being influenced by variations in pressure drop.

To this end, a lubrication system according to the invention for an internal combustion engine with at least one piston reciprocating in an engine cylinder, which lubrication system comprises an oil pump with adjustable feed pressure and which is controlled via a pressure-sensing means that is acted on by the working pressure of the oil. The system is characterized in that the pressure-sensing means is acted on via a pressure outlet which is hydraulically connected to one of the bearings of the internal combustion engine that are lubricated by the lubrication system. By virtue of this design of the lubrication system, the measurement of the system pressure takes place out at a consumer (utilizing arrangement on the lubrication system), without being influenced by variations in pressure drop.

In one illustrative embodiment of the invention, the pressure outlet is arranged in a crankshaft bearing cap.

In another illustrative embodiment of the invention, the pressure outlet is connect to the bearing at a point which, in relation to the direction of rotation of the shaft, is displaced in said direction by at least approximately 160° from the mouth of the feed duct of the lubrication system to the bearing.

In another illustrative embodiment of the invention, the oil pump can be mounted adjacent to the crankshaft bearing cap.

According to an advantageous variant of the invention, the pressure-sensing means is arranged so as to open a passage which connects the delivery side of the oil pump to its suction side when a pressure exceeding a predetermined level is registered. Alternatively, a passage can be opened to the oil sump of the engine.

BRIEF DESCRIPTION OF THE DRAWINGS

The invention will be described in greater detail below with reference to illustrative embodiments shown in the accompanying drawings, and in which.

DETAILED DESCRIPTION

Figure 1:
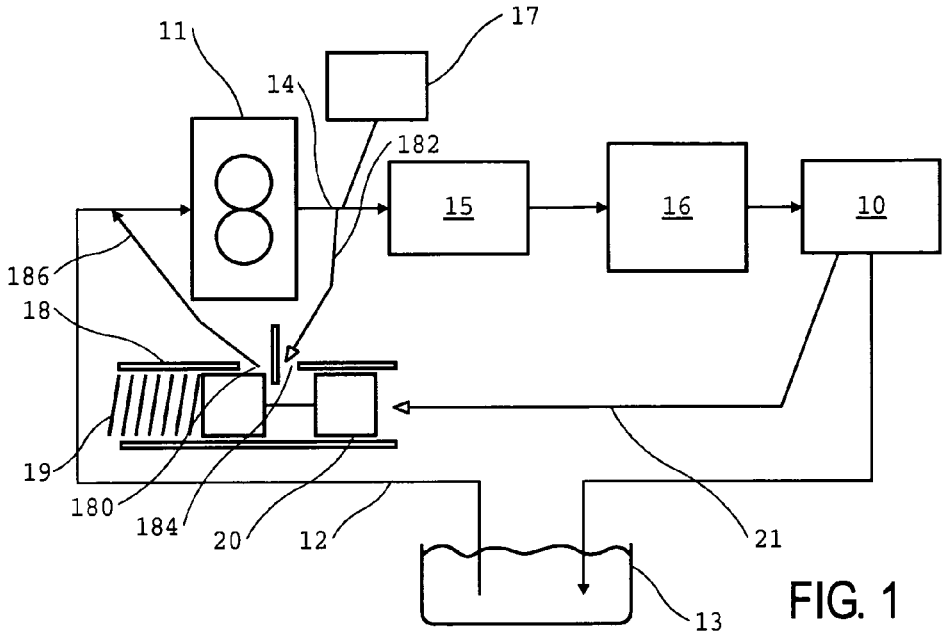
FIG. 1 diagrammatically illustrates a lubrication system configured according to the teachings fo the present invention.

FIG. 1 shows a lubrication system, intended for an internal combustion engine 10, which comprises (includes, but is not necessarily limited to) an oil pump 111 that draws lubricating oil from an oil sump 13 via a suction line 12. The delivery side of the pump is connected to the engine 10 in series via a pressure line 14, an oil cooler 15 and a filter housing 16. A safety valve 17 that is connected to the pressure line has the function of monitoring and limiting the system pressure so that the system pressure does not rise above a certain level.

A reducing valve 18 is connected in parallel with the pump 11 to the suction line 12 and the pressure line 14, which valve has a pilot piston 20 which is displaceable counter to the action of a spring means 19. This piston is acted on by the system pressure in the lubrication system via a pressure outlet 21 in such a way that the pilot piston opens a passage that includes a first port 180 and a second port 184 between the pressure line 14 and the suction line 12 when the pressure in the pressure outlet 21 exceeds a certain level. Excess pressure from the pressure outlet displaces the pilot piston 20 to open the first port 180. As the first port 180 opens, lubricating oil returns from the pressure line 14 through a connection 182 to the reducing valve 18. The lubricating oil continues through the second port 184 and the first port 180 into the suction line 12 along a second connection 186. In this connection, surplus pressure/flow can be returned to the suction side of the pump. At normal working temperature and with a pressure/flow which exceeds said level, and so that the reducing valve stands open, the pressure drop across the oil cooler and the filter will be reduced, as the flow is adjusted in the pump, the risk of the lubricating oil being overcooled decreasing. A higher average temperature of the oil normally reduces the friction losses in an internal combustion engine.

Figure 2:
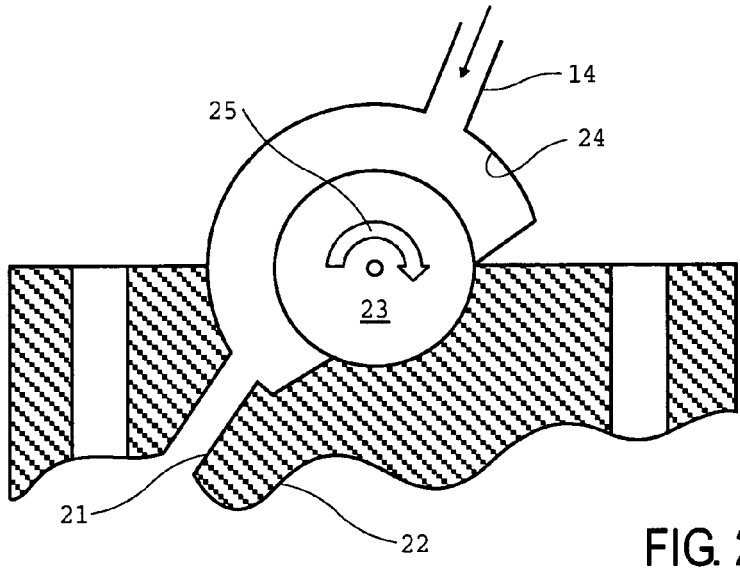
FIG. 2 is a cross-sectional view taken through a crankshaft bearing configured with lubrication ducts according to the present invention.

FIG. 2 shows the connection between the reducing valve 18 and a suitable measuring point for registering system pressure. In this case, this point is located at a crankshaft bearing cap 22 which, together with other similar crankshaft bearing caps, forms a support for the crankshaft 23. The point consists of the mouth of the pressure outlet 21 which connects the oil groove 24 of the crankshaft bearing to the pilot piston 20 of the reducing valve.

In the illustrative embodiment according to FIG. 2, the mouth of the pressure outlet 21 is displaced in the direction of rotation (arrow 25) of the shaft 23 by slightly more than 180° from the mouth of the feed duct 14 of the lubrication system to the bearing. When the crankshaft rotates, a pressure difference is generated by pumping, which is proportional to the rotation speed. The oil pump 11 can therefore deliver a higher pressure/flow when the speed of the engine increases.

The oil pump 111 is suitably mounted directly on the crankshaft bearing cap 22, and the pressure outlet 21 can then extend through the crankshaft bearing cap. In this way, the lubrication system according to the invention can be brought about in a cost-effective way.

The invention is not to be regarded as being limited to the illustrative embodiments described above, but a number of further variants and modifications are conceivable within the scope of the following patent claims. For example, the pressure outlet 21 can be arranged in locations in the engine other than at a crankshaft bearing. The oil pump does not have to be mounted on a crankshaft bearing cap.

What is claimed is:

1. A lubrication system for an internal combustion engine with at least one piston reciprocating in an engine cylinder, said lubrication system comprising:

an oil pump (11) with adjustable feed pressure and being controlled via a pressure reducing valve (18) which is acted on by the working oil pressure via a pressure outlet (21) that is hydraulically connected to a bearing (24) of the internal combustion engine, said bearing (24) being lubricated by the lubrication system; and said pressure outlet (21) being arranged in a crankshaft bearing cap (22) of the engine and a mouth of said pressure outlet (21) being displaced in a direction of rotation (25) of a shaft (23) away from a mouth of a feed duct 14 of the lubrication system to the bearing so that the rotation speed of the shaft influences the oil pressure in the bearing.

2. The lubrication system as recited in claim 1, wherein the pressure outlet (21) connects to the bearing at a point which, in relation to the direction of rotation of the shaft, is displaced in said direction by at least approximately 160° from the mouth of the feed duct (14) of the lubrication system to the bearing.

3. The lubrication system as recited in claim 2, wherein the oil pump (11) is mounted adjacent to the crankshaft bearing cap (22).

4. The lubrication system as recited in claim 1, wherein the pressure reducing valve (18) is arranged so as to open a passage which connects the delivery side (14) of the oil pump to its suction side (12) when a pressure exceeding a predetermined level is registered.

5. The lubrication system as recited in claim 1, wherein the pressure reducing valve (18) is arranged so as to open a passage which connects the delivery side (14) of the oil pump to an oil sump (13) when a pressure exceeding a predetermined level is registered.

6. A lubrication system for an internal combustion engine with at least one piston reciprocating in an engine cylinder, which lubrication system comprises an oil pump (11) with adjustable feed pressure which is controlled via a pressure reducing valve (18) which is acted on by the working pressure of the oil via a pressure outlet (21) which is hydraulically connected to one of the bearings (24) of the internal combustion engine which are lubricated by the lubrication system, characterized in that the pressure outlet (21) is arranged in one of the crankshaft bearing caps (22) of the engine, and that a mouth of the pressure outlet (21) is displaced in the direction of rotation (25) of a shaft (23), away from a mouth of the feed duct 14 of the lubrication system to the bearing, in such a way that the rotation speed of the shaft influences the oil pressure in the bearing.

7. The lubrication system as claimed in claim 6, characterized in that the pressure outlet (21) connects to the bearing at a point which, in relation to the direction of rotation of the shaft, is displaced in said direction by at least roughly 160° from the mouth of the feed duct (14) of the lubrication system to the bearing.

8. The lubrication system as claimed in claim 7, characterized in that the oil pump (11) is mounted adjacent to the crankshaft bearing cap (22).

9. The lubrication system as claimed in claim 6, characterized in that the pressure reducing valve (18) is arranged so as to open a passage which connects the delivery side (14) of the oil pump to its suction side (12) when a pressure exceeding a predetermined level is registered.

10. The lubrication system as claimed in claim 6, characterized in that the pressure reducing valve (18) is arranged so as to open a passage which connects the delivery side (14) of the oil pump to an oil sump (13) when a pressure exceeding a predetermined level is registered.

* * * * *